US007513003B2

(12) United States Patent
Mossbeck

(10) Patent No.: US 7,513,003 B2
(45) Date of Patent: Apr. 7, 2009

(54) ANTI-SNORE BED HAVING INFLATABLE MEMBERS

(75) Inventor: Niels S. Mossbeck, Carthage, MO (US)

(73) Assignee: L & P Property Management Company, South Gate, CA (US)

( * ) Notice: Subject to any disclaimer, the term of this patent is extended or adjusted under 35 U.S.C. 154(b) by 251 days.

(21) Appl. No.: 11/559,585

(22) Filed: Nov. 14, 2006

(65) Prior Publication Data

US 2008/0109965 A1 May 15, 2008

(51) Int. Cl.
*A61F 5/56* (2006.01)
*A47C 20/00* (2006.01)

(52) U.S. Cl. ..... 5/731; 5/733; 5/715; 5/615; 128/848

(58) Field of Classification Search ..... 5/615, 5/715, 731, 733, 720; 128/848
See application file for complete search history.

(56) References Cited

U.S. PATENT DOCUMENTS

| | | | | |
|---|---|---|---|---|
| 3,013,281 | A | 12/1961 | Steiner | |
| 3,089,130 | A | 5/1963 | Wilson | |
| 4,788,533 | A | 11/1988 | Mequignon | |
| 4,848,360 | A | 7/1989 | Palsgard et al. | |
| 5,042,097 | A * | 8/1991 | Fuchs | 5/607 |
| 5,092,007 | A * | 3/1992 | Hasty | 5/715 |
| 5,105,488 | A * | 4/1992 | Hutchinson et al. | 5/710 |
| 5,113,539 | A * | 5/1992 | Strell | 5/710 |
| 6,098,223 | A * | 8/2000 | Larson | 5/716 |
| 6,386,201 | B1 * | 5/2002 | Fard | 128/848 |
| 6,986,182 | B2 * | 1/2006 | Mossbeck | 5/727 |
| 2004/0234080 | A1 | 11/2004 | Hernandez et al. | |
| 2006/0139165 | A1 | 6/2006 | Bader | |
| 2006/0162074 | A1 | 7/2006 | Bader | |

FOREIGN PATENT DOCUMENTS

| | | |
|---|---|---|
| DE | 1198005 | 8/1965 |
| DE | 4137631 | 5/1992 |
| WO | WO8603663 | 7/1986 |

* cited by examiner

*Primary Examiner*—Michael Trettel
(74) *Attorney, Agent, or Firm*—Wood, Herron & Evans, LLP

(57) ABSTRACT

A bedding product having a pocketed spring assembly comprising a plurality of parallel strings of springs joined to each other. Each of the strings of springs has a length and a width and comprises a row of interconnected pockets. Each of the pockets contains at least one spring encased in fabric. The bedding product may have a plurality of inflatable members located underneath select portions of at least some of the strings of springs. Each of the inflatable members may be of a width substantially equal to the width one of the string of springs. The bedding product may have a sensor assembly adapted to detect a sound associated with human snoring and an air supply system operatively coupled to the sensor assembly and adapted to control a supply of air to the inflatable members.

19 Claims, 8 Drawing Sheets

ANTI-SNORE BED HAVING INFLATABLE MEMBERS

FIELD OF THE INVENTION

The present invention relates generally to bedding products. More specifically, it is directed to a bed adapted to stop the snoring of one or more persons sleeping thereon.

BACKGROUND OF THE INVENTION

Various ways have been developed to prevent snoring. Snoring may disturb persons sleeping in the same room or on the same bed as the person snoring. From time to time snoring can become so loud that it may even awaken the snoring person or others in the same room or bed. Some may deal with a snorer by waking him/her up to cause the snoring to stop, but this causes the snorer's sleep to be interrupted. Furthermore, after going back to sleep, snoring may start again, often shortly afterwards.

Snoring may occur when soft tissue in the back of a person's mouth relaxes during sleep, especially when a person sleeps on his or her back. The relaxation of the tissue may partially block the airway, which causes the body of the person to react by breathing harder, which in turn causes vibration of the tissue that results in a snoring sound. In some cases it has been determined that the snoring sounds do not occur if and as long as the person concerned sleeps in a particular position, such as lying on his or her side. Fewer people tend to snore when lying on their side, as the soft tissue may not obstruct the airway in the same manner as when the person is lying on his or her back.

German Patent No. 1198005, for example, teaches a device including a padded board having the same length as the upper part of a person's body and which may be hinged along the longitudinal axis of the board. The board may be equipped with a locking device that locks the part of the board that can be lifted up at an angle of between 60 degrees and 90 degrees. Such a device may be equipped at both ends with loops through which one leg and one arm are disposed so that the sleeping person is forced into the side position by the part that is lifted up. This type of device, however, may not be conducive to restful sleep since the sleeping person is pinned in a side position and is not able to turn around.

U.S. Pat. No. 3,089,130 teaches a device adapted to be mounted on a bed in which the head of the sleeping person is put on a head support that can be tilted and is equipped with a vibrator. Snoring sounds are detected by a microphone and are fed as a control signal to a control system that then activates the vibrator. By actuation of the vibrator, the head of the sleeping person is shaken up and down so that he/she wakes up, thereby causing the snoring to cease. Such a device also has the disadvantage of interrupting the sleep of the person, often numerous times throughout the night.

U.S. Pat. No. 4,788,533 teaches a device for interrupting the snoring of a sleeping person as soon as the snoring begins. The device includes a microphone which picks up the snoring noise emitted by an individual and compares the intensity of the snoring noise detected by the microphone to a threshold level. In the event the detected noise is above the threshold, a sound device is actuated which does not awaken the subject but does subconsciously cause a change in behavior in the subject.

U.S. Pat. No. 4,848,360 discloses a device for preventing the snoring of a sleeping person which again does not wake the person. The device includes a box having a microphone which picks up the snoring noise emitted by an individual and filters out other sounds. In the event the snoring continues for more than a specified period of time, i.e. thirty seconds, a vibrator is actuated which does not awaken the subject but does influence him/her to change his or her sleeping position.

The use of these devices does not provide that the snorer will change his or her sleeping position to stop the snoring. Therefore there is a need for a bedding product and associated method suitable to stop a person's snoring by changing his or her sleeping position without substantially disturbing his/her sleep.

SUMMARY OF THE INVENTION

These and other problems in the prior art are addressed by this invention which, in one embodiment, includes a bedding product comprising a pocketed spring assembly having a height, length and width and comprising a plurality of parallel strings of springs joined to each other. Each of the strings of springs comprises a row of interconnected pockets, each of the pockets containing at least one spring encased in fabric.

The product may have a plurality of inflatable members located underneath select portions of at least some of the strings of springs. Each of these inflatable members may be of a width substantially equal to the width of one of these strings of springs or any other desired width.

The product may further include a sensor assembly adapted to detect a sound associated with human snoring and an air supply system operatively coupled to the sensor assembly and adapted to control a supply of air to the inflatable members. Such air control may be accomplished with a controller or processor which may control a plurality of valves in lines extending from the inflatable bladders or members. Depending upon the size of the bed, any number of inflatable members may be used at any desired location.

The product may include padding and an upholstered covering surrounding the pocketed spring assembly, padding and inflatable members. The product may include strings of springs that extend longitudinally (from head to foot) or transversely (from side to side). Alternatively, the product may be adapted to distinguish and respond to respective sounds associated with snoring of at least two persons sleeping on the bedding product.

A method of inducing a change of sleeping position of a person sleeping on a surface of a bedding product having a plurality of inflatable members may include detecting a sound corresponding to snoring of the person, responding to the sound by instructing an air supply system operatively coupled to at least some inflatable members to cause a flow of air to occur between the air supply system and at least some of the inflatable members. The inflation of the inflatable members causes a portion of the upper surface of the product lying above at least one of the inflatable members to raise upwardly to induce the person sleeping above the at least one inflatable member to roll over and stop snoring.

BRIEF DESCRIPTION OF THE DRAWINGS

These and other objectives and advantages will become readily apparent to those of ordinary skill in the art from the following description of embodiments of the invention and from the drawings in which.

DETAILED DESCRIPTION

Figure 1:
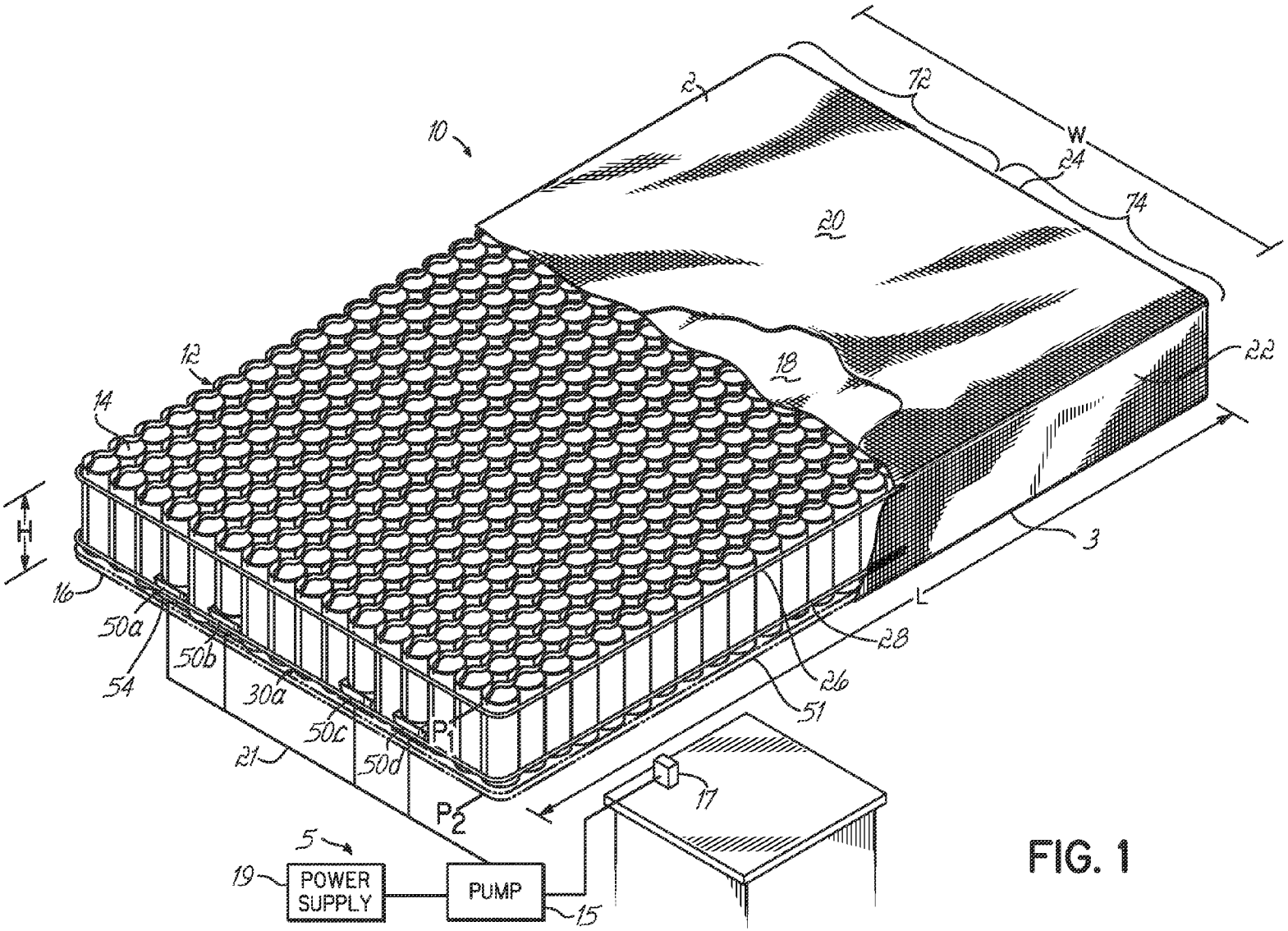
FIG. 1 is a perspective view of a mattress containing a pocketed spring assembly, a sensor assembly, a set of inflatable members and an air supply system.

Referring to the drawings, particularly to FIG. 1, a bedding product in the form of a mattress 10 comprises a pocketed spring assembly 12 having a generally planar top surface 14 in a top plane P1 and a parallel generally planar bottom surface 16 in a bottom plane P2. Covering pads 18 (only one being shown) may be located on the top and bottom surfaces 14, 16 of the pocketed spring assembly 12. An upholstered covering 20 encases the pocketed spring assembly 12 and the covering pads 18. This embodiment of mattress is similar to the product disclosed in U.S. Pat. No. 6,986,182 which is fully incorporated by reference herein.

The mattress 10 has a height H defined as the distance between the top and bottom surfaces 2, 3 of the mattress 10. Similarly, the mattress 10 has a transverse dimension or width W defined between opposed side surfaces 22 and a longitudinal dimension or length L defined as the distance between the opposed end surfaces 24 of the mattress 10. The longitudinal dimension is illustrated as being larger than the transverse dimension of the mattress 10 although the longitudinal and transverse dimensions may alternatively be identical, such as in a square mattress.

The pocketed spring assembly 12 of mattress 10 comprises a plurality of longitudinally extending (from head to foot) strings of springs 30 joined together by one or more of known suitable methods. One or more border wires may be secured to the pocketed spring assembly 12 with adhesive, hog rings or any other conventional fasteners or methods. FIG. 1 illustrates an upper border wire 26 and a lower border wire 28, both of which are generally rectangular, secured to the pocketed spring assembly 12. Alternatively only one border wire or any other structure suitable to restrict outward lateral movement of the pocket assembly 12 may be incorporated into the product, if desired.

Figure 2:
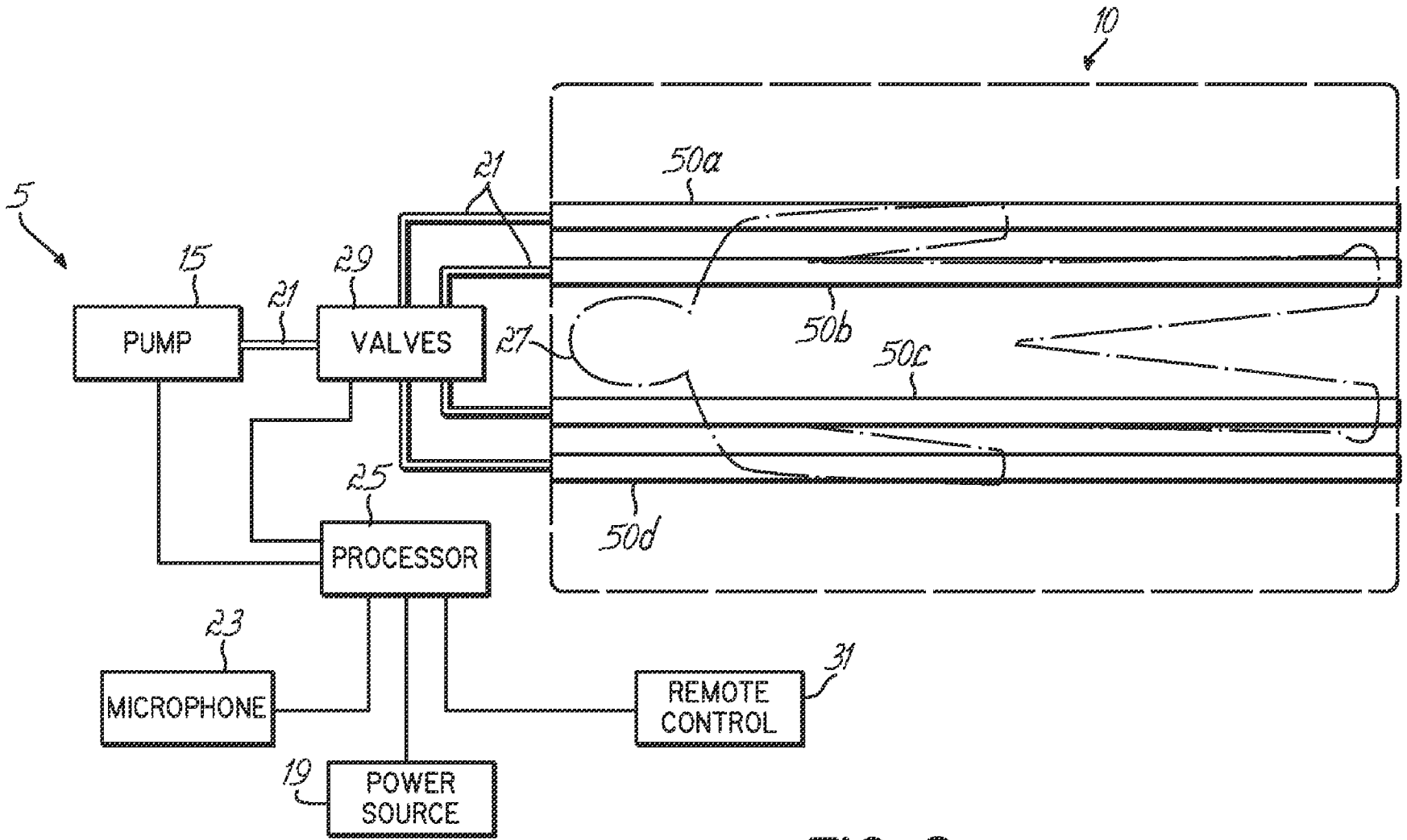
FIG. 2 is a schematic view depicting an exemplary air supply system and sensor assembly controlling inflation of a set of inflatable members in the mattress of FIG. 1.

With continued reference to FIG. 1, the mattress 10 has a plurality of inflatable pneumatic members in the form of bellows 50*a, b, c, d* extending in a longitudinal direction at select locations across the width W of the bedding product or mattress 10. As shown in FIG. 2, each of the inflatable pneumatic members 50*a, b, c, d* extends the entire length of the mattress 10, from one end 24 to the other end. Each of the inflatable members 50*a*-50*d* has a width substantially equal to the width of one of the strings of springs.

Although four inflatable pneumatic members 50*a, b, c, d* are illustrated, the mattress 10 may have any number of inflatable pneumatic members at any desired locations. Due to inflation of the inflatable pneumatic members 50*a, b, c, d*, the mattress 10 may be divided into multiple regions or sections of differing firmness as one moves transversely along the mattress 10. Therefore, the mattress 10 may have, for example, a first section 72 and a second section 74. See FIG. 1. The inflatable pneumatic members 50*a*, 50*b* of section 72 may, for example, be inflated to a greater degree than the inflatable pneumatic members 50*c*, 50*d* in section 74 to increase the firmness of section 72 relative to the firmness of the section 74. Although this embodiment is illustrated having two inflatable pneumatic members per each of two sections 72, 74, the mattress 10 may also be manufactured with any number of inflatable pneumatic members per section and/or include more than two sections.

Each of the inflatable pneumatic members 50*a, b, c, d* may be further secured to a lower scrim sheet 51. More particularly, the lower surface 54 of each of the inflatable pneumatic members 50*a, b, c, d* may be secured to the lower scrim sheet 51. A method of securing each of the inflatable pneumatic members 50*a, b, c, d* to the lower scrim sheet 51 may include adhesive or any other suitable method of affixation of the two surfaces involved.

An air supply system 5 generally includes an air pump 15 supplying air to each of the pneumatic members or bellows 50*a, b, c, d* in mattress 10, while a sensor assembly 17 controls the functionality and air distribution from the pump 15 into the inflatable bellows 50*a, b, c, d*. FIGS. 1 and 2 further show a power supply or source 19 supplying electrical power to the sensor assembly 17 and air pump 15. Air supply lines 21 fluidly connect the air pump 15 to each of the bellows 50*a, b, c, d*.

With reference to FIG. 2, a more detailed schematic is shown of air supply system 5 supplying air to bellows 50*a, b, c, d*. Sensor assembly 17 (see FIG. 1) comprises a microphone 23 and a processor 25. Microphone 23 is suitable to detect and distinguish sounds such as those produced by conventional human snoring. Microphone 23 is positioned proximate mattress 10 to detect sounds made by a person 27 lying on mattress 10. Processor 25 is suitably connected to microphone 23 such that processor 25 may receive a signal from microphone 23 and send, when a specific set of logic conditions is met, respective electric signals to an air pump 15 and to a set of valves 29 located between air pump 15 and bellows 50*a, b, c, d*.

In one aspect of this embodiment, valves 29 independently control air flow to each of the bellows 50*a, b, c, d* such that a specific set of instructions from processor 25 may, for example, include inflating each of the bellows 50*a, b, c, d* to a different degree or alternatively inflating some of the bellows 50*a, b, c, d* while not inflating others. Alternatively, valves 29 may jointly (i.e. not independently) control all of the bellows in one specific section of mattress 10 so that a set of instructions may comprise, for example, inflating both bellows 50*a, b* in section 72 of mattress 10 while maintaining both of the bellows 50*c, d* in section 74 in a deflated condition or inflated to a different level relative to bellows 50*a, b*. A remote control unit 31 is depicted controlling the functionality of processor 25. Remote control unit 31 may permit, for example, calibration of the processor 25 to different sounds received by the microphone 23 and programming of the reaction to a specific set of sounds. Remote control unit 31 may further allow individual or joint energizing and deenergizing of the microphone 23, processor 25, air pump 15 or valves 29 to block or override their automated operation if desired.

Figure 2A:
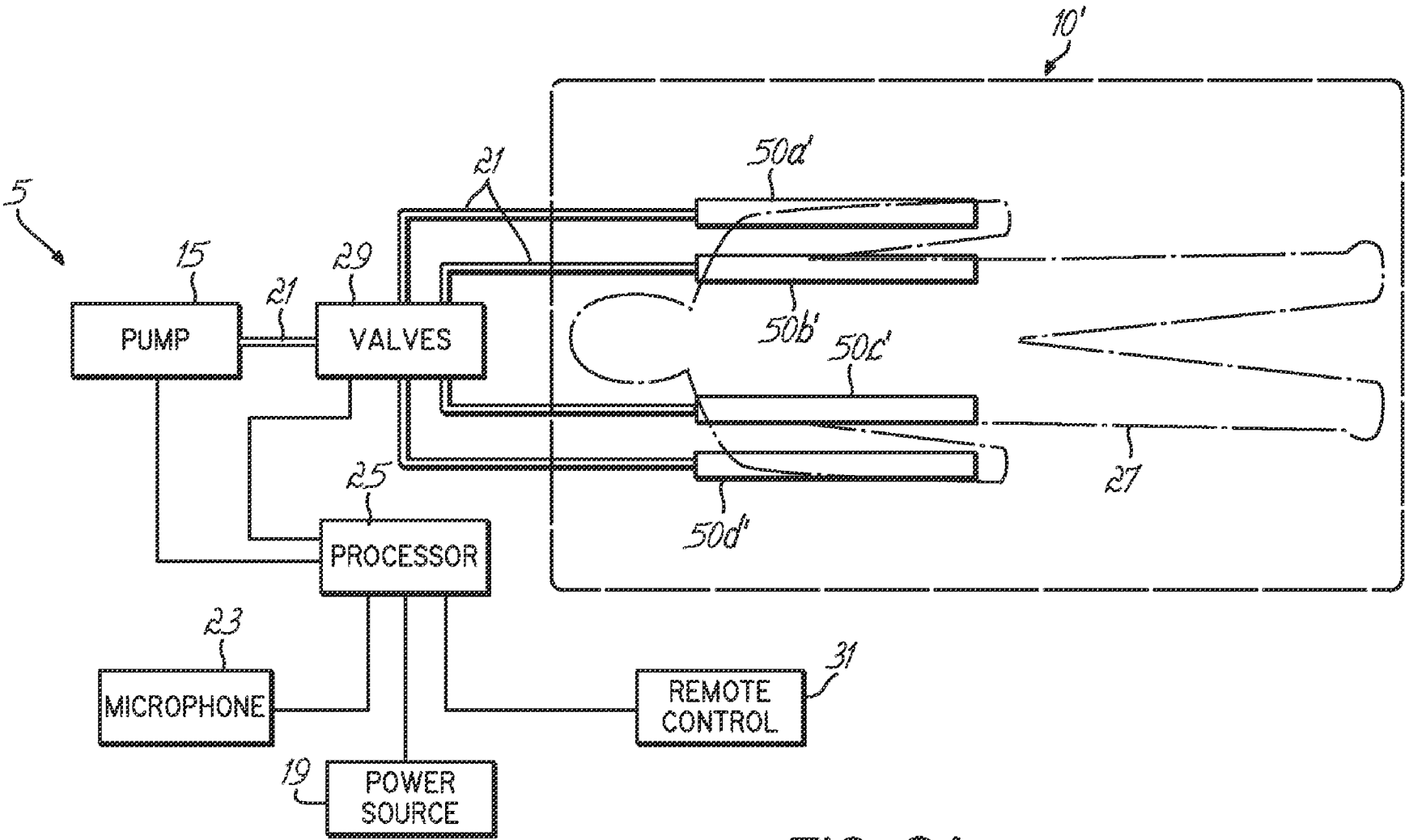
FIG. 2A is a schematic view depicting an alternative air supply system and sensor assembly controlling inflation of a set of inflatable members.

FIG. 2A illustrates a view like FIG. 2 showing inflatable members 50*a*', 50*b*', 50*c*' and 50*d*' of a length less than the length of the mattress 10. These inflatable members 50*a*', 50*b*', 50*c*' and 50*d*' are illustrated as each extending from the shoulder to the waist or hips of an individual lying on the mattress 10'. However, they may be any desired length, just like the inflatable members shown in FIGS. 1 and 2.

Figure 3:
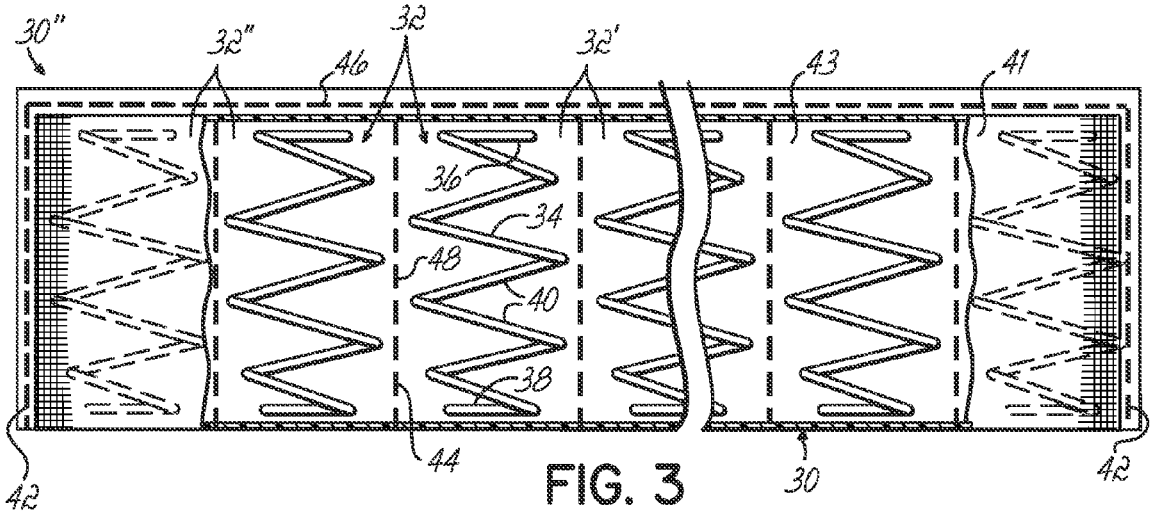
FIG. 3 is a partial elevation view of a section of the pocketed spring assembly of FIG. 1.

With reference to FIG. 3, each string of springs 30 comprises a row of interconnected fabric pockets 32. Each of the fabric pockets 32 contains at least one coil spring 34 having an upper end turn 36, a lower end turn 38 and a plurality of central convolutions 40 between the end turns 36, 38. Preferably, only one piece of fabric is used to form a string of springs 30, the piece of fabric being folded over onto itself around the coil springs 34. As is known in the art, opposite sides or plies 41, 43 of the fabric are sewn, welded or otherwise secured together in order to create a pair of outermost seams 42, a plurality of internal seams 44 and a top seam 46. The internal seams 44 separate adjacent pockets 32 and therefore adjacent coil springs 34. Although the seams 42, 44 and 46 are illustrated as being a plurality of spaced, linear segments 48, they may alternatively comprise continuous lines or a series of dots or other suitable arrangement.

Figure 4:
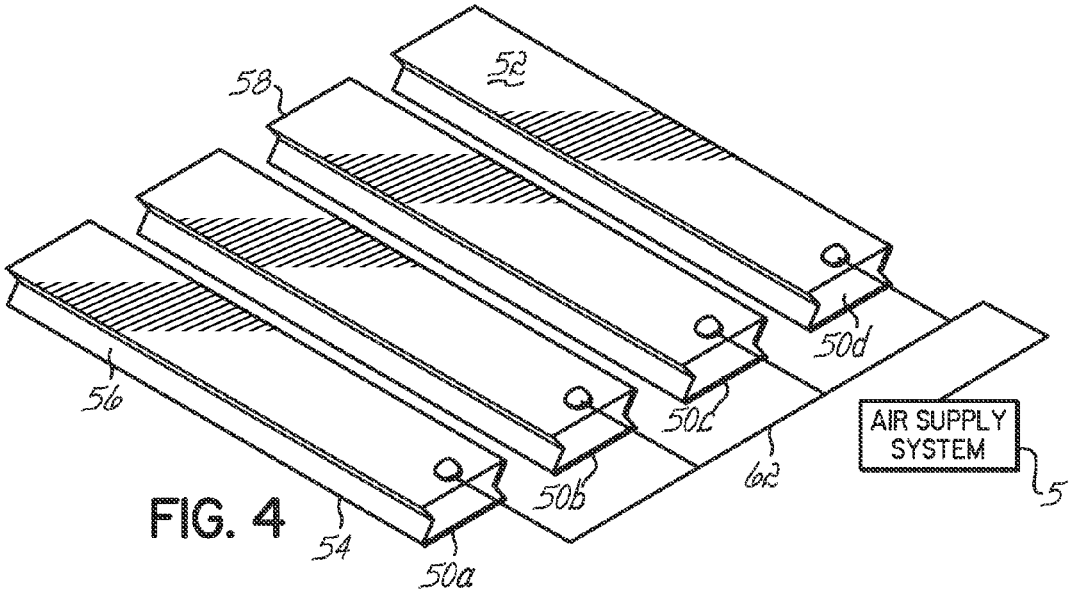
FIG. 4 is a partial perspective view of the set of inflatable members of FIG. 1.

With reference to FIG. 4, the mattress 10 has a plurality of inflatable pneumatic members in the form of bellows 50*a, b, c, d* extending in a longitudinal direction at select locations across the width W of mattress 10. Although four bellows 50*a, b, c, d* are depicted, the mattress 10 may have any number of bellows or other type of inflatable pneumatic members at any desired locations. Each of the bellows 50*a, b, c, d* has an upper surface 52, a lower surface 54, side surfaces 56 and end surfaces 58. Although one configuration of bellows 50*a, b, c, d* is depicted, the bellows 50*a, b, c, d* may assume other shapes and configurations. The bellows 50*a, b, c, d* may be constructed from a variety of materials such as neoprene, butyl rubber and the like. Optionally, the bellows 50*a, b, c, d* may be covered exteriorly with a cloth cover (not shown) to reduce noise resulting from their operation or interaction with surrounding strings of springs 30, such as squeaking. Air supply system 5 controls the flow of air via air supply lines 21 fluidly connected to each of the bellows 50*a, b, c, d*. An air pump 15 powered by a power source 19 provides air through the supply line 21 to the bellows 50*a, b, c, d*.

Figure 5:
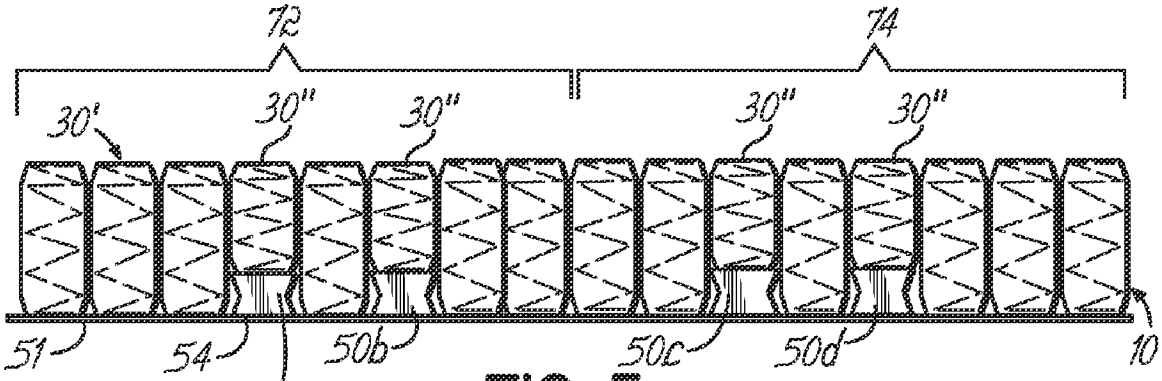
FIG. 5 is an elevation cross-sectional view of the pocketed spring assembly and inflatable members of FIG. 1.

With reference to FIG. 5, each of the bellows 50*a, b, c, d* extends longitudinally in a direction parallel the strings of springs 30. In one embodiment, some of the strings of springs 30' are secured to the lower scrim sheet 51 and do not have bellows 50*a, b, c, d* thereunder. Methods of securing these strings of springs 30' to the lower scrim sheet 51 may include adhesive or any other suitable methods of affixation. Other strings of springs 30" are located directly above inflatable pneumatic members 50*a, b, c, d* and secured thereto. The lower surfaces of the strings of springs 30" are secured to the upper surface 52 of the inflatable pneumatic members 50*a, b, c, d* located directly underneath the longitudinally extending strings of springs 30". Methods of securing these strings of springs 30" to the upper surface 52 of the inflatable pneumatic members 50*a, b, c, d* is may include adhesive or any other suitable methods of affixation. In the embodiment depicted in FIG. 5, the pocketed spring assembly 12 of the mattress 10 is divided into two adjacent regions or sections 72, 74 as one moves transversely across the width W of mattress 10.

Figure 6:
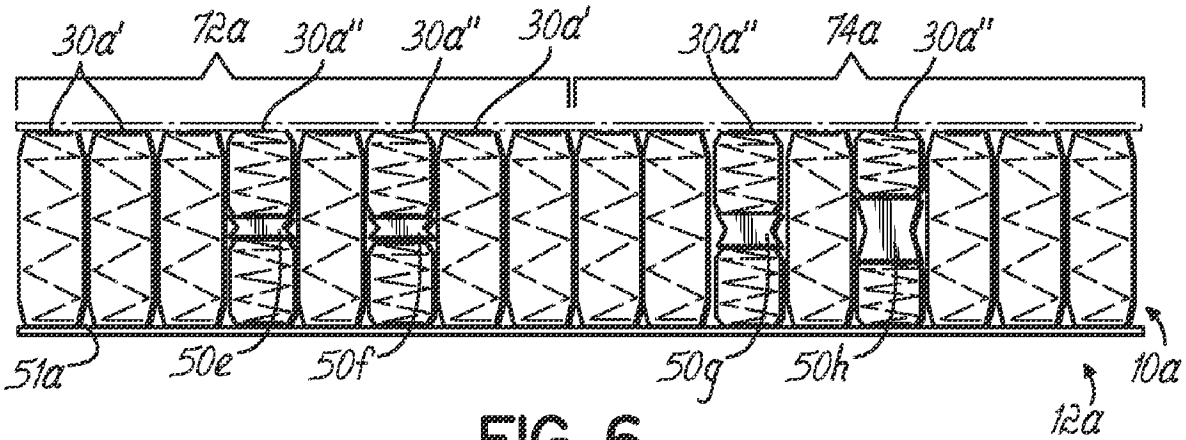
FIG. 6 is an elevation cross-sectional view of an alternative embodiment of a pocketed spring assembly and a set of inflatable members.

With reference to FIG. 6, an alternative mattress 10*a*, commonly referred to in the industry as a two-sided product, which may be used on either side, has a pocketed spring assembly 12*a* which is divided into two adjacent sections 72*a*, 74*a*, across the width W' of the mattress 10*a*. Mattress 10*a* further includes a lower scrim sheet 51*a*. The pocketed spring assembly 12*a* comprises a plurality of longitudinally extending strings of springs 30*a*. Strings of springs 30*a*' in sections 72*a*, 74*a* are secured to a lower scrim sheet 51*a*. Four inflatable pneumatic members 50*e, f, g, h* are sandwiched between strings of springs 30*a*". Although only one scrim sheet 51*a* is depicted in FIG. 6, another scrim sheet (not shown) may be secured to the opposite surface of the mattress 10*a*. Strings of springs 30*a*" are secured to both the upper and lower surfaces of the inflatable pneumatic members 50*e, f, g, h*. Each of the strings of springs 30*a*" below the inflatable pneumatic members 50*e, f, g, h* of the pocketed spring assembly 12*a* is secured to the lower scrim sheet 51*a*. Although four inflatable pneumatic members 50*e, f, g, h* are illustrated in the in pocketed spring assembly 12*a*, any number of inflatable pneumatic members may be located in any of the sections of the pocketed spring assembly 12*a*.

Figure 7A:
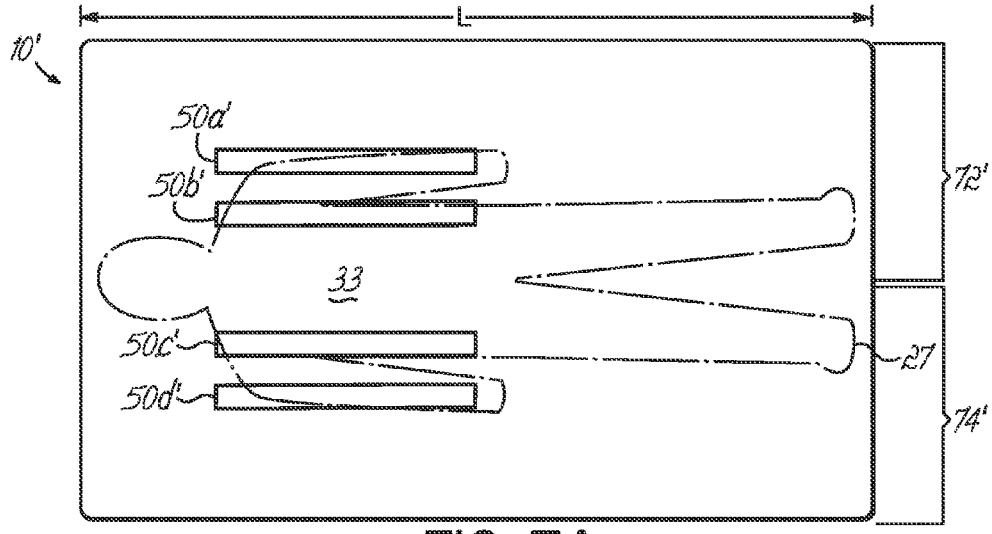
FIG. 7A is a top view of the mattress and inflatable members of FIG. 2A in conjunction with a person lying on the mattress.
Figure 7B:
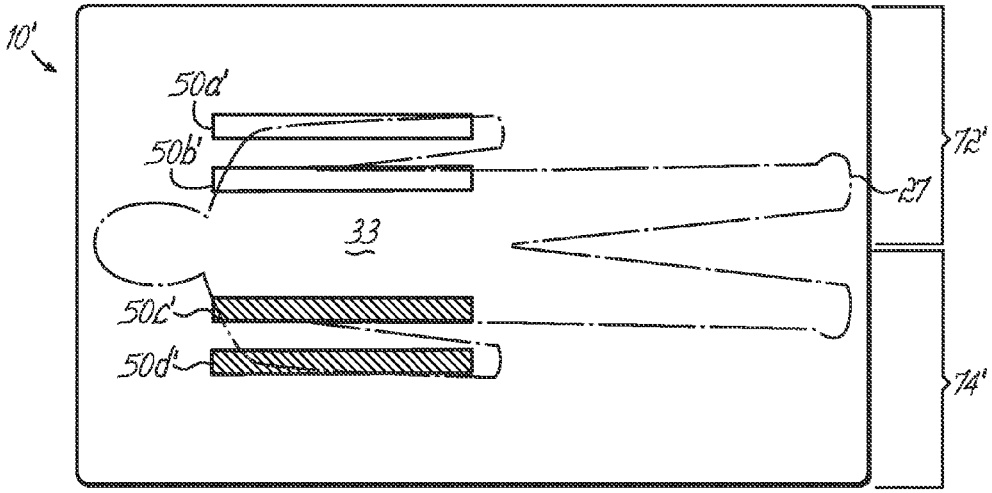
FIG. 7B is a top view of the mattress and inflatable members of FIG. 7A in conjunction with a person lying on the mattress showing a first set of two inflatable members in an inflated condition.
Figure 7C:
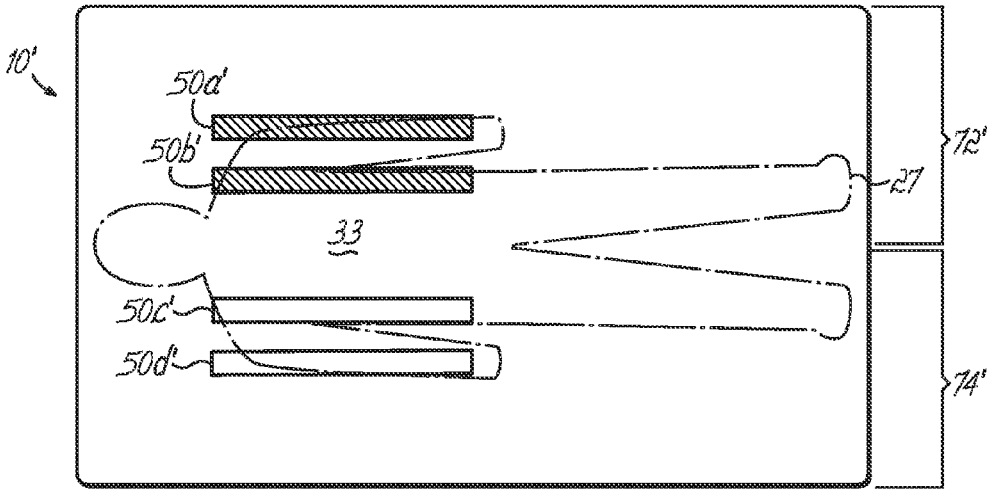
FIG. 7C is a top view of the mattress and inflatable members of FIG. 7A in conjunction with a person lying on the mattress showing a second set of inflatable members in an inflated condition.

FIGS. 7A, 7B and 7C illustrate an exemplary position of an individual 27 lying on mattress 10' (shown in FIG. 2A) and an exemplary length of inflatable members 50*a', b', c', d'*. Two bellows 50*a', b'* lie under one side of a person 27 lying on mattress 10' and correspond to a general section 72' of mattress 10'. Two bellows 50*c', d'* lie under the other side of a person 27 and correspond to section 74' of mattress 10'. Bellows 50*a', b', c', d'* may have a length substantially shorter than length L of mattress 10 and be longitudinally located proximate a torso portion 33 of person 27. While FIGS. 7A-7C depict bellows 50*a', b', c', d'* of a length substantially shorter than the length L of mattress 10, bellows 50*a', b', c', d'* may alternatively have any suitable length such that the bellows may exert a sufficient force against a selected portion of the person 27 when inflated. Bellows 50*a', b', c', d'* may, for example, have a length substantially equal to that length L of mattress 10.

FIG. 7A shows bellows 50*a', b', c', d'* in a deflated condition. FIG. 7B depicts the bellows 50*a',b'* in section 72' of mattress 10' in a deflated condition, while bellows 50*c', d'* of section 74' are in an inflated condition. Conversely, FIG. 7C depicts the bellows 50*c',d'* in section 74' of mattress 10' in a deflated condition, while bellows 50*a', b'* of section 72' are in an inflated condition.

Figure 8A:
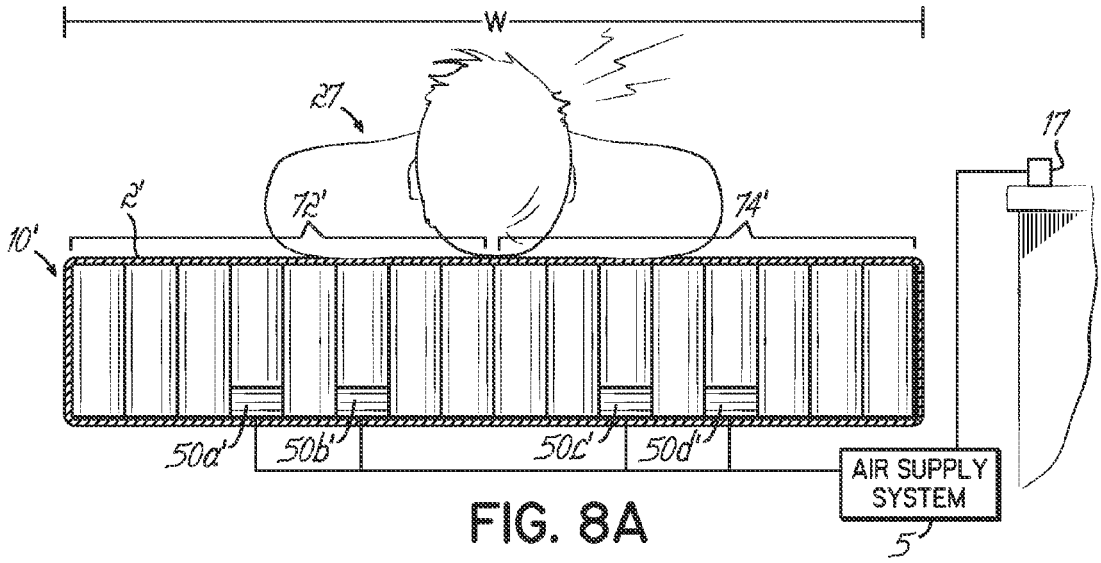
FIG. 8A is a cross-sectional view of the product shown in FIG. 7A with all inflatable members being deflated.
Figure 8B:
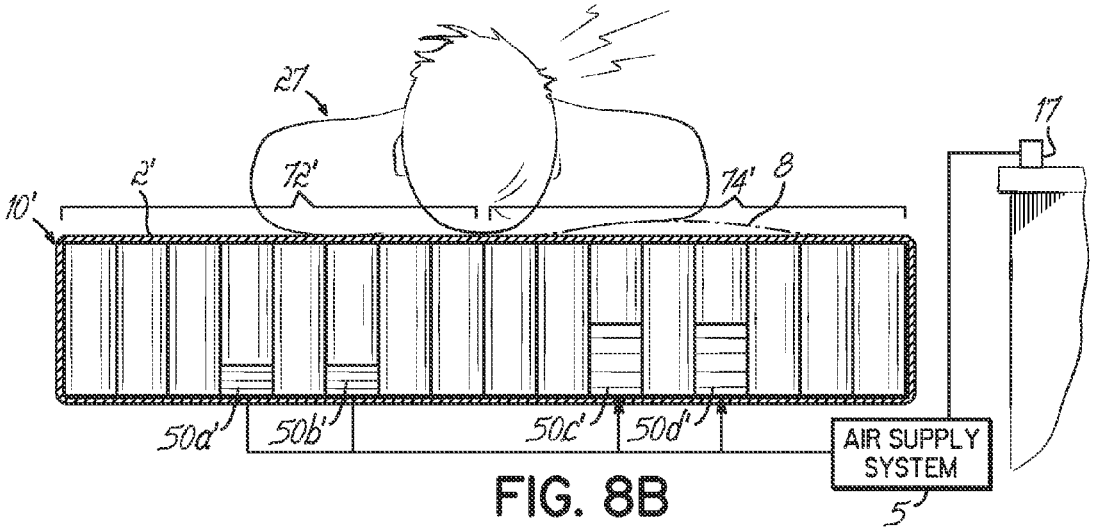
FIG. 8B is cross-sectional view of the product shown in FIG. 7B showing two inflatable members being inflated to induce a person to change sleeping positions.

With reference to FIGS. 8A, 8B, 8C, 8D, the three conditions of bellows 50*a, b, c, d* depicted in FIGS. 7A-7C are shown along with their intended effect on a person 27 sleeping on mattress 10'. FIG. 8A shows person 27 sleeping, face up, generally centered across the width W of mattress 10 and bellows 50*a', b', c', d'* in a deflated condition. Symbolically depicted sensor assembly 17 may detect a snoring sound coming from person 27. Upon recognizing the sound, sensor assembly 17 may send respective signals to air pump 15 and one or more of valves 29 (FIG. 2) of air supply system 5 to inflate one or more of the bellows 50*a', b', c', d'* of mattress 10'. FIG. 8B shows an exemplary event, in which the processor or controller 25 has sent signals, as described above, to valves 29 to cause air to flow into and thereby inflate bellows 50*c', d'* in section 74' of mattress 10', while maintaining bellows 50*a', b'* in section 72' in a deflated condition.

Figure 8C:
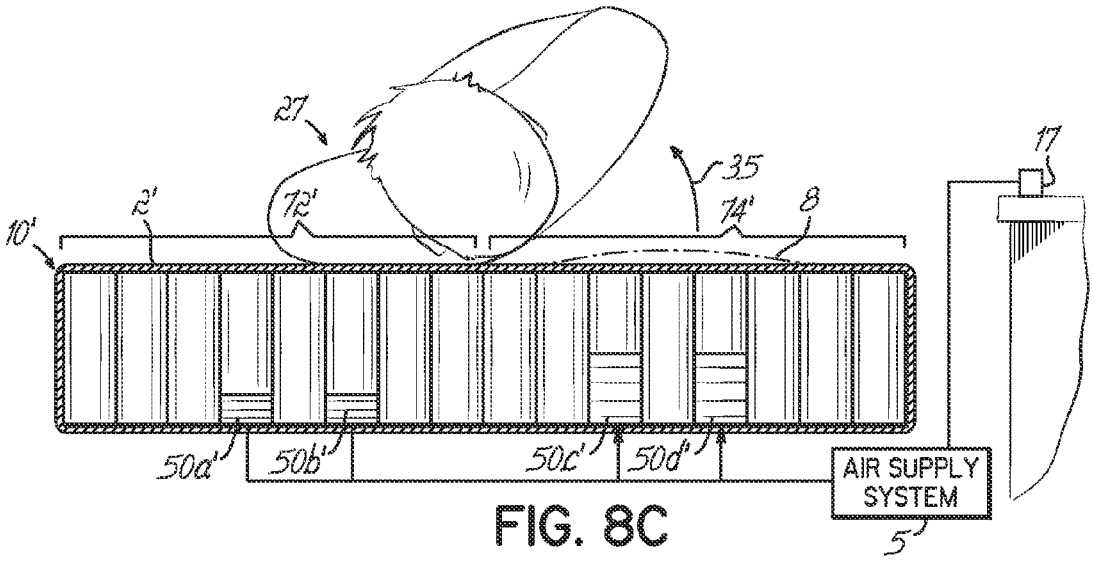
FIG. 8C is cross-sectional view like FIG. 8B of the product shown in FIG. 7B with the individual rolling over.
Figure 8D:
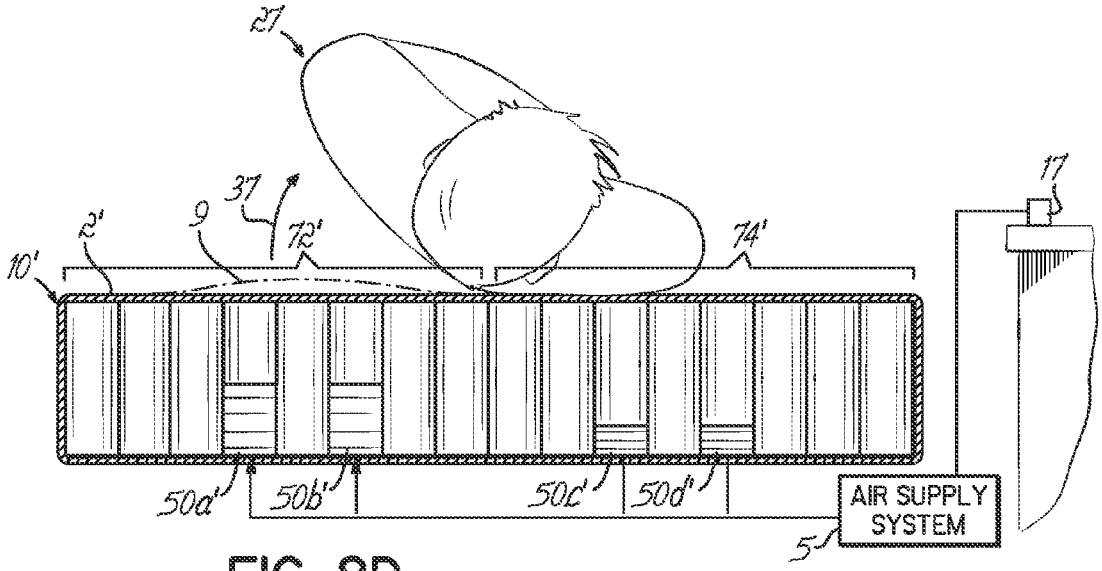
FIG. 8D is a cross-sectional view of the product shown in FIG. 7C two other inflatable members being inflated to induce the person to change sleeping positions.

With reference to FIGS. 8B and 8C, inflation of bellows 50*c', d'* causes an upward motion of a portion of the upper surface 2' of mattress 10' in section 74', thereby creating a bump 8 and inducing person 27 to at least partially rotate from his original position depicted in FIG. 8A, in the general direction of arrow 35. FIG. 8D shows another exemplary event, in which, upon recognizing a snoring sound, sensor assembly 17 has sent signals to the controller 25, as described above, which controls valves 29 to control flow of air into inflatable bellows 50*a', b'* in section 72' of mattress 10', while maintaining bellows 50*c', d'* in section 74' in a deflated condition. Inflation of bellows 50*a', b'* causes an upward motion of a portion of the upper surface 2' of mattress 10' in section 72, thereby creating a bump 9 and inducing person 27 to at least partially rotate from his original position depicted in FIG. 8A, in the general direction of arrow 37.

While the embodiment of FIGS. 8A-8D depicts an operation such that both bellows in a section of a mattress such as bellows 50*a', b'* in section 72' of mattress 10' are inflated at the same time and to the same degree (i.e. to the fully inflated condition), persons of ordinary skill in the art will recognize that only one of the bellows in a section of a mattress is inflated or be such that the bellows in a given section are inflated to different degree or level from that depicted herein. In a section containing two bellows, for example, one bellow may be inflated to 50% of its capacity while the remaining bellow may be inflated to 80% of its capacity. In another aspect of this embodiment, sensor assembly 17 may send corresponding signals to the air supply system 5 to bleed the bellows 50*a', b', c', d'* from an inflated condition, thereby returning mattress 10 to its original, horizontal condition as best depicted in FIG. 8A. Those skilled in the art will appreciate that while FIGS. 7A-7C and 8A-8D are described with respect to the bellows 50*a'*-50*d'*, the operation of bellows 50*a*-50*d* shown in FIGS. 1 and 2 may operate in the same manner.

Figure 9:
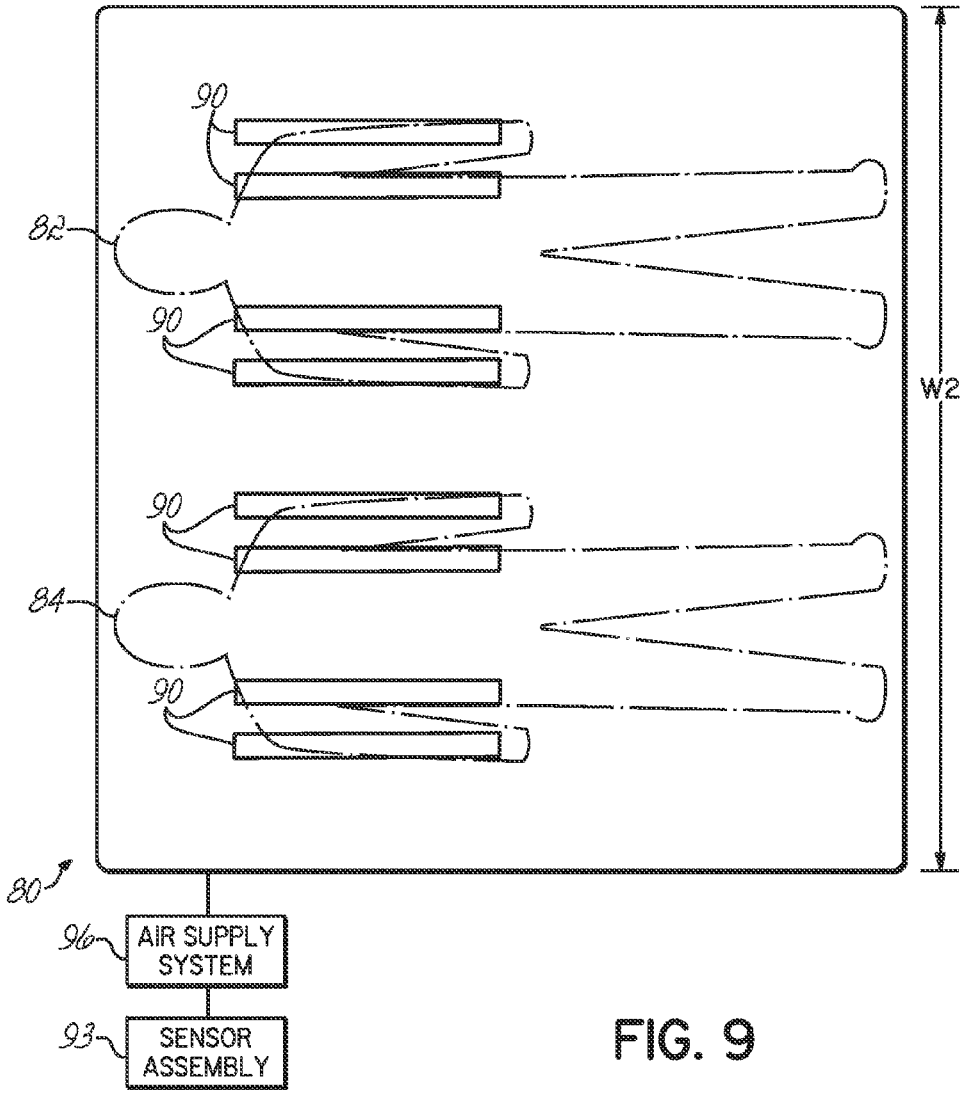
FIG. 9 is an alternative embodiment of a mattress comprising a pocketed spring assembly, inflatable members in conjunction with two persons lying on the mattress.

With reference to FIG. 9, an alternative embodiment of a mattress 80 of a width W2 greater than width W of mattress 10 may, for example, correspond to what is commonly known in the art as a "queen size" bed or alternatively a "king size" bed. Mattress 80 is wide enough to hold more than one person, such as persons 82, 84 depicted in FIG. 9 and may include four pairs of bellows 90 disposed in a fashion similar to that of mattress 10, wherein each pair lies below one side of a torso of each person 82, 84. Symbolically represented sensor assembly 93 controls symbolically represented air supply system 96, which controls flow of air into and out of bellows 90. In one aspect of the embodiment of FIG. 9, a suitable operation may exemplarily comprise of a sensor assembly 93 capable of recognizing two distinct sets of snoring sounds associated with each of the two persons 82, 84 that normally sleep on mattress 80. Upon recognizing a snoring sound coming, for example, from person 82, such sensor assembly would send respective signals to air supply system 96 to cause inflation of respective bellows supporting a section of the mattress 80 where person 82 normally sleeps. Alternatively, sensor assembly 93 may comprise two microphones (not shown) respectively located proximate each person 82, 84 and connected to one or more processors (not shown) such that each microphone corresponds to one specific set of bellows associated with a section of the mattress 80. In such an alternative embodiment, the sensor assembly 96 would not be required to recognize the snoring sound of a specific person 82, 84 over the other, nor would it be required to send a signal to air supply system 96 to inflate a specific set of bellows under a section of the mattress 80 over which a specific person is expected to lie.

Accordingly, many further embodiments, applications and modifications of the invention will become readily apparent to those of ordinary skill in the art without departing from the scope of the invention which is defined by the claims appended hereto.

What is claimed is:

1. A bedding product comprising:

a pocketed spring assembly comprising a plurality of parallel strings of springs joined to each other, each of said strings of springs comprising a row of interconnected pockets, each of said pockets containing at least one spring encased in fabric;

a plurality of inflatable members located underneath select portions of at least some of said strings of springs;

a sensor assembly adapted to detect a sound associated with human snoring; and an air supply system operatively coupled to said sensor assembly and adapted to control a supply of air to at least some of said inflatable members; and an upholstered covering surrounding said pocketed spring assembly and said inflatable members.

2. A bedding product comprising:

a pocketed spring assembly comprising a plurality of parallel strings of springs joined to each other, each of said strings of springs comprising a row of interconnected pockets, each of said pockets containing at least one spring encased in fabric;

a plurality of inflatable members located underneath select portions of at least some of sAd strings of springs;

a sensor assembly adapted to detect a sound associated with human snoring; and an air supply system operatively coupled to said sensor assembly and adapted to control a supply of air to at least some of said inflatable member.

3. The product of claim 2, wherein said strings of springs extend longitudinally.

4. The product of claim 2, wherein said air supply system is adapted to independently control respective air flow into each of said inflatable members.

5. The product of claim 2, wherein each of said inflatable members is of a width substantially equal to the width of one of said strings of springs.

6. The product of claim 2, wherein said bedding product is adapted to receive at least two persons sleeping contemporaneously thereon.

7. The product of claim 6, wherein said sensor assembly is adapted to distinguish respective snoring sounds coming from the at least two persons.

8. The product of claim 6, wherein said air supply system is configured to respond differently to respective snoring sounds coming from the at least two persons.

9. The product of claim 6, wherein said sensor assembly comprises at least two microphones.

10. The product of claim 2, wherein said inflatable members have a length less than the length of one said strings of springs.

11. The product of claim 2, wherein said inflatable members have a length substantially equal to the engths of said strings of springs.

12. The product of claim 2, wherein said inflatable members are vertically sandwiched between two of said strings of springs.

13. The product of claim 2, wherein said air supply system is adapted to cause deflation of said inflatable members.

14. A bedding product comprising:

a pocketed spring assembly comprising a plurality of parallel strings of springs joined to each other, each of said strings of springs having a length and a width and comprising a row of interconnected pockets, each of said pockets containing at least one spring encased in fabric;

a plurality of inflatable members located underneath select portions of at least some of said strings of springs, each of said inflatable members being of a width substantially equal to the width of one of said strings of springs;

a sensor assembly adapted to detect a sound associated with human snoring; and an air supply system operatively coupled to said sensor assembly and adapted to control a supply of air to said inflatable members.

15. The product of claim 14, wherein said strings of springs extend longitudinally.

16. The product of claim 14, wherein said product has four inflatable members.

17. The product of claim 14, wherein said product has eight inflatable members.

18. A method of inducing a change of sleeping position of a person sleeping on an upper surface of a mattress, said mattress having a resilient upper portion divided into resilient longitudinally extending sections, said mattress also having a plurality of inflatable members located beneath selected ones of said resilient longitudinally extending sections, which selected longitudinally extending sections are spaced from side edges of the mattress and beneath sections which support the shoulders of the person sleeping on said upper surface, the method comprising:

detecting a sound corresponding to snoring of the person; and responding to the sound by instructing an air supply system operatively coupled to the plurality of inflatable members to cause air flow between the air supply system and at least one of the inflatable members.

19. The method of claim 18 wherein inflation of at least one of the inflatable members raises a portion of the upper surface of the mattress.

* * * * *

UNITED STATES PATENT AND TRADEMARK OFFICE

CERTIFICATE OF CORRECTION

PATENT NO. : 7,513,003 B2
APPLICATION NO. : 11/559585
DATED : April 7, 2009
INVENTOR(S) : Niels S. Mossbeck It is certified that error appears in the above-identified patent and that said Letters Patent is hereby corrected as shown below:

Title Page

Item [57] "Abstract", line 9, "to the width one" should be --to the width of one--.

Column 3

Line 26, "is cross-sectional" should be --is a cross-sectional--.

Line 29, "is cross-sectional" should be --is a cross-sectional--.

Line 32, "FIG. 7C two" should be --FIG. 7C; two--.

Column 6

Line 5, "50a, b, c, d is may" should be --50a, b, c, d may--.

Lines 28-29, "in the in pocketed" should be --in the pocketed--.

Column 8

Line 33, claim 2 "some of sAd strings" should be --some of said strings--.

Line 38, claim 2 "inflatable member" should be --inflatable members--.

Column 8

Line 59, claim 10 "of one said strings" should be --of one of said strings--.

Line 62, claim 11 "enghts" should be --lengths--.

Signed and Sealed this

Sixth Day of October, 2009

David J. Kappos

David J. Kappos
*Director of the United States Patent and Trademark Office*